US007204028B1

(12) United States Patent
Mills

(10) Patent No.: US 7,204,028 B1
(45) Date of Patent: Apr. 17, 2007

(54) PERSPECTIVE VIEW DRAFTING DEVICE

(76) Inventor: John A. Mills, 4269 Gilead Shores RD., Blounts Creek, NC (US) 27814

( * ) Notice: Subject to any disclaimer, the term of this patent is extended or adjusted under 35 U.S.C. 154(b) by 0 days.

(21) Appl. No.: 11/163,321

(22) Filed: Oct. 14, 2005

(51) Int. Cl.
*B43L 13/14* (2006.01)

(52) U.S. Cl. ..... 33/432; 33/434; 33/1 K

(58) Field of Classification Search ..... 33/432, 33/433, 434, 1 K, 18.3, 20.3
See application file for complete search history.

(56) References Cited

U.S. PATENT DOCUMENTS

| | | | | |
|---|---|---|---|---|
| 2,495,694 A | * | 1/1950 | Cain | 33/430 |
| 2,553,026 A | * | 5/1951 | Williams et al. | 33/23.01 |
| 3,872,597 A | * | 3/1975 | Tennant | 33/432 |
| 4,075,762 A | * | 2/1978 | Ohtake | 33/434 |
| 5,632,094 A | | 5/1997 | Mills | 33/432 |

FOREIGN PATENT DOCUMENTS

| | | | |
|---|---|---|---|
| GB | 1537022 A | * | 12/1978 |
| GB | 2212765 A | * | 8/1989 |

* cited by examiner

*Primary Examiner*—R. Alexander Smith
(74) *Attorney, Agent, or Firm*—Mills Law Firm PLLC

(57) ABSTRACT

A drafting device creating perspective views from horizontal base lines with remote horizontal vanishing points and with a remote skyline vanishing point. The drafting device includes articulated arm assemblies on opposite sides of the board. Each arm assembly includes a lower straight edge that is pivotally connected by primary and secondary arms to a pivot arm pivotally mounted at opposed sides of the drawing board, thereby establishing an adjustable four-bar linkage that allows the straight edge to be oriented at vertically varying horizontal base lines with horizontal vertical vanishing points remote from the drawing board and variable perspective angles. In combination with ordinary drafting tools and scales, the drafter can create three dimensional objects as viewed from a horizontal base line perspective.

5 Claims, 3 Drawing Sheets

PERSPECTIVE VIEW DRAFTING DEVICE

FIELD OF THE INVENTION

The present invention relates to drawing systems and, in particular, to a drafting device for drawing perspective views at varying horizons from horizontal and vertical vanishing points remote from the drawing surface.

BACKGROUND OF THE INVENTION

An articulated drafting device for drawing perspectives is disclosed in my prior patent, U.S. Pat. No. 5,632,094, wherein articulated arm assemblies provide a drawing capability for vanishing points that can be located outside the drawing surface, thereby avoiding the complexities and limitations of prior systems. The drafting device has particular benefits for students who did not possess the equipment or expertise to produce realistic three dimensional drawings in a classroom setting, where limited space is available. The arm assemblies can be selectively pivoted at the outer horizontal and vertical edges of the drawing board to vary drawing placement and angular perspective. The system was thus very versatile in allowing the students to draw perspective views from an upper or skyline horizon perceived by looking downwardly on the drawn objects. Foreshortening scales were provided for enhancing the realism of the objects as the skills of the students progressed. The system has been embraced by students and educators.

It has been observed that younger students tend to view objects from a lower base line or horizontal horizon perspective, looking outward and upward at objects, such as buildings and tall objects. While very flexible, my prior system was not well adapted for producing views from a lower, and particularly, a lower horizontal base horizon. Accordingly, it is thought that such a capability would further extend the capabilities and enjoyment of students and other drafting aspirants.

SUMMARY OF THE INVENTION

The present invention provides a drafting device that enables the drafter to create perspective views from horizontal base lines with remote horizontal vanishing points and with a remote skyline vanishing points. The drafting device includes articulated arm assemblies on opposite sides of the board. Each arm includes a lower straight edge that is pivotally connected by primary and secondary arms to a pivot arm or bracket pivotally mounted at opposed sides of the drawing board, thereby establishing an adjustable four-bar linkage that allows the straight edge to be oriented at vertically varying horizontal base lines with horizontal vertical vanishing points remote from the drawing board and a variable perspective angles. In combination with ordinary drafting tools and scales, the drafter can create three dimensional objects as viewed from a horizontal base line perspective. Using a foreshortening scaler, the drafter can produce enhanced perspective views as their skills increase.

Accordingly, it is an object to provide a drafting device for creating horizontal base line perspective drawings.

Another object is to provide a drafting device for drawing base line perspective views with vertical skyline vanishing points remote from the drawing surface.

A further object is to provide a drafting teaching aid for students in drawing three dimensional objects from a lower horizontal perspective.

BRIEF DESCRIPTION OF THE DRAWINGS

The above and other features and advantages of the present invention will become apparent upon reading the following description taken in conjunction with the accompanying drawing in which.

DESCRIPTION OF THE PREFERRED EMBODIMENT

Figure 1:
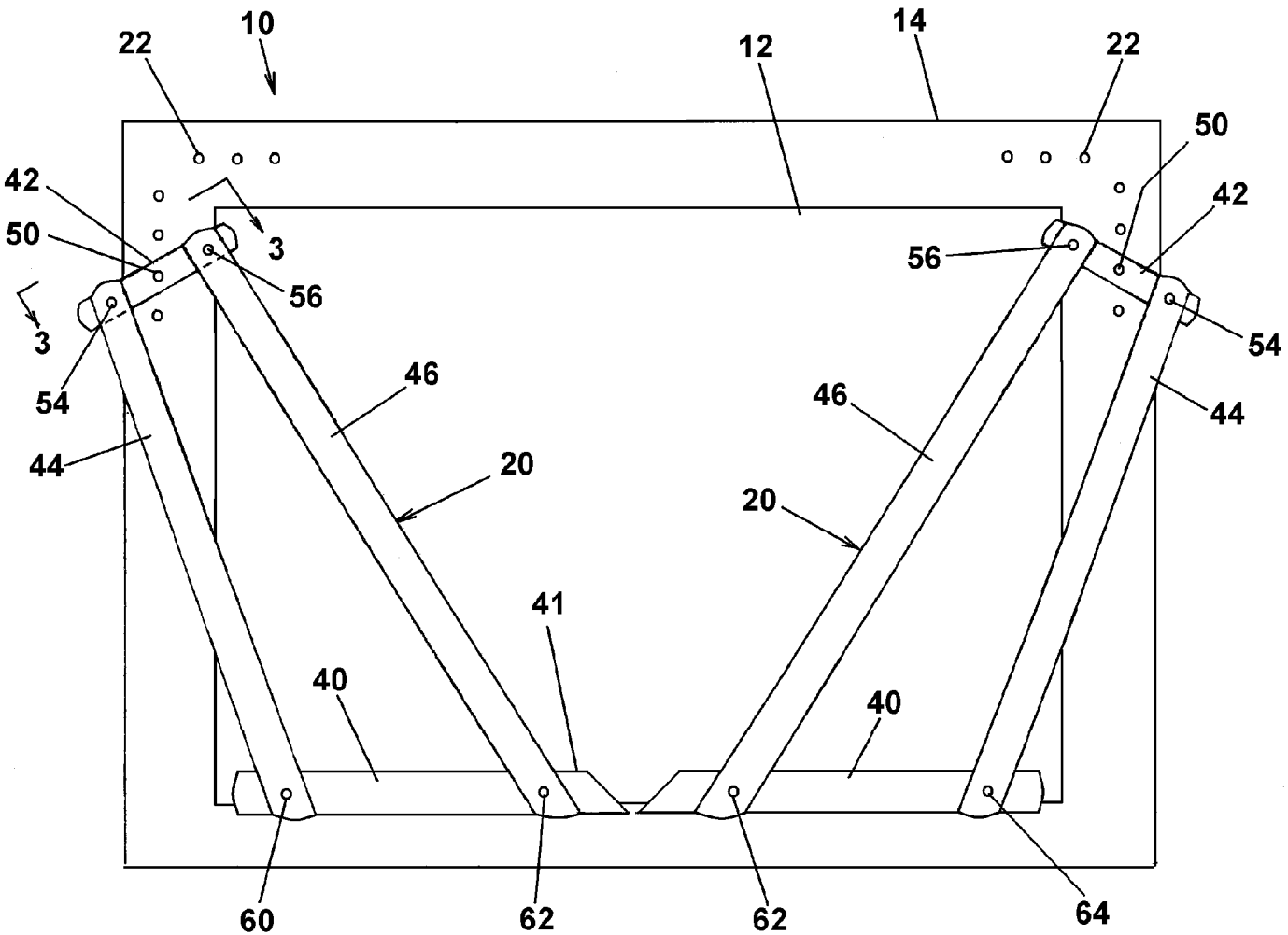
FIG. 1 is a plan view drawing board provided with an articulated drafting assembly in accordance with an embodiment of the invention.

Referring to FIG. 1, there is shown a perspective drafting device 10 for drawing perspective views on a sheet of drawing paper 12 carried on a drawing board 14. The drafting device 10 includes a pair of laterally spaced articulated arm assemblies 20 selectively connected at a plurality of vertical and horizontal mounting holes 22 at the sides and top of the drawing board 14.

Figure 2:
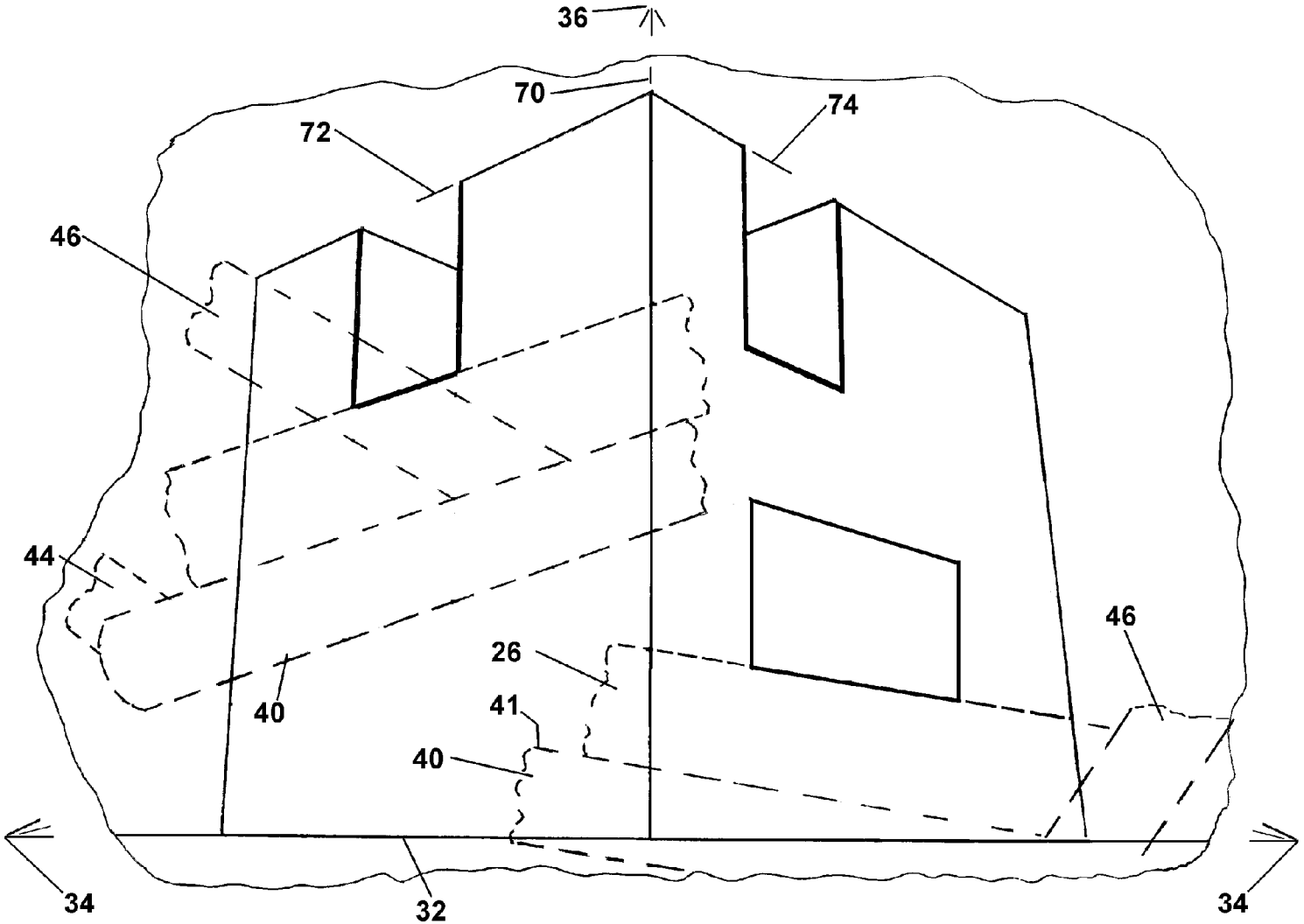
FIG. 2 is a fragmentary plan view of a horizontal perspective view drawn with the assembly of FIG. 1.
Figure 4:
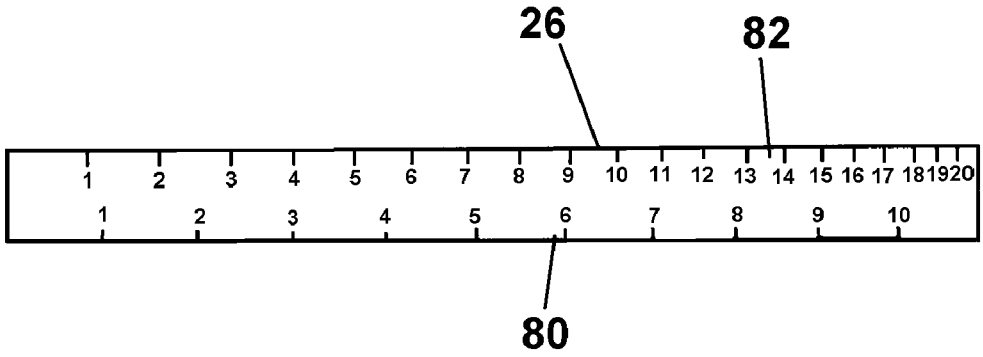
FIG. 4 is a front view of a foreshortening scaler for use in conjunction with the drafting assembly of FIG. 1.

Referring to FIG. 2, the drafting device 10, in conjunction with standard peripheral drafting instruments and the foreshortening scaler 26 shown in FIG. 4, provides the capability for student of varying ages and skill levels to draw perspective objects, such as the illustrated building 30, having a perspective from a lower horizontal base line 32, and with perspective lines substantially intersecting at lateral vanishing points 34 and a vertical vanishing point 36 remote from the paper 12. While the base line 32 is shown at the bottom of the building, the base line may also be established at varying elevations thereof. For maximizing the realism associated with intermediate positions, it is generally preferred to pick a location at a distinctive visual break, such as a width change.

Figure 3:
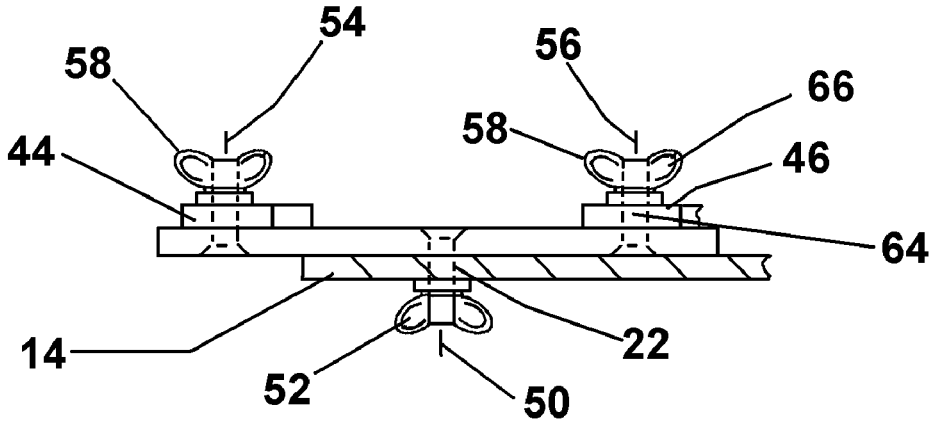
FIG. 3 is a cross sectional view taken along line 3—3 in FIG. 1.

Each arm assembly 20 includes a lower base arm 40 having a straight edge upper linear surface 41. The base arm 40 is connected to an upper pivot arm 42 by outer primary and inner secondary connecting arms 44, 46, respectively, thereby establishing a four-bar linkage. Referring additionally to FIG. 3, each pivot arm 42 is centrally pivotally connected to the drawing board 14 at a center pivot connection 50 established by fastener 52 at one of the side mounting holes 22. The upper ends of the connecting arms 44, 46 are pivotally connected at the ends of the pivot arm 42 at upper pivot connections 54, 56 by fasteners 58. The lower ends of the connecting arms 44, 46 are pivotally connected to the outer end and center portion of the straight edge member 40 at pivot connections 60, 62, respectively, by fasteners comparable to the fasteners 58. The fasteners 52, 58 comprise threaded shanks 64 inserted through aligned apertures in the coupled parts carrying wing nuts 64 adjustable for fixedly or pivotally connecting the parts thereat. Rather than mounting the pivot arm 42 at mounting holes on the board, the mounting may be provided at removable clips allowing use of the device without alteration of the drawing board.

The pivot arm 42 is rotatable about the pivot connection 50 to raise or lower the horizontal orientation of the base arm 40 on the board to establish the horizontal base line 32 at a desired location on the paper 12 as accommodated by the linkage. The arm assemblies are configured to optimize the available drawing area on the paper.

By way of example, for a 12 inch by 18 inch drawing board, a mounting hole about ⅓ or 4 inches from the top is satisfactory. Therefrom, desired horizontal vanishing points are determined based on artistic preferences at a base line 32 at the lower portion of the board, thereby establishing a horizontal position for the straight edge member. A length for the primary connecting arm 44 is established for connecting the outer end of the pivot arm 42 to the end of the base arm 40. Preferably, the primary arm 44 has a shallow inward inclination with respect to the side of the board. Thereafter, at a raised position of the arm assembly for drawing an object in the upper portion of the paper, the angle of the straight edge member for intersecting the selected vanishing point is established. Thereafter, the distance between the pivot points 60, 62 and the length of the secondary arm 46 are selected for achieving the best geometric fit for fulfilling the movement constraints. The procedure is repeated for varying inclinations of the pivot arm, and the varying horizontal base lines. The arm geometry is then further refined on a best fit basis to provide a substantial convergence on the vanishing point. In this connection, for the above board size, it has been determined that a pivot arm inclined about 30° with pivot connections spaced at a 1¼ inch radius, a primary arm length of 7 inches between connections, and a secondary arm length of 8¾ inch between connections located the straight edge member parallel with the bottom of the board has been determine to provide effective drawing areas on standard drawing sheets.

The drafting device is thus well suited for creating the base line perspective view of the structure 30 shown in FIG. 2. Initially the base line 32 is established at the desired location on the paper 12 by adjustment of the arm assemblies 20 accommodated by the pivoting of the pivot arms 42 and alignment of the straight edge members 40 through adjustment of the linkages. Thereafter, the fastener 52 is tightened to fixedly position the pivot arm 42. The base line 32 is preferably constructed by slidably locating the scaler 26 at the top surface 41 of the base arm 40, thereby providing an extended ruler line. From the base line a vertical center line 70 is established with a suitable drafting instrument. The center line 70 is then graduated using the scaler. The base line 32 is graduated on either side of the center line 70, also with the scaler 26. The scaler is used to provide any foreshortening desired. Thereafter, the arm assemblies 20 and scaler are adjusted for drawing and graduating the top borders 72, 74, and their termini connected for completing the outline. Against the basic gridwork thus established the remaining details are created. Shown in dashed lines are the representative arm assembly positions for creating additional details. It will be apparent that the pivot arm 42 may be rotated and adjusted to provide perspectives at varying perspective angles from a nominal horizontal line, i.e. 5°, 10° etc. from a vertical elevation line.

As the skills of the students increase, advanced foreshortening techniques may be employed for enhance the vertical and perspective realism. Each scaler includes an indicia 80 of uniform gradation, and indicia 82 of decreasing gradation. The appropriate gradations are selected based on the size of the objects drawn. Tall buildings would have more foreshortening or perspective than a box of comparable size on the paper.

The drafting device thus enables the drafter to create base line horizon drawings with horizontal and vertical vanishing points. Further, the arm assemblies may be located in the top mounting holes for also creating the isometric perspectives of my prior patent.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claim.

What is claimed is:

1. A drafting device for drawing perspective lines from a lower base line horizon, said drafting device comprising: a drawing board providing the drawing surface; and a pair or articulated arm assemblies, each of said arm assemblies including an upper pivot arm including means for pivotal connection at a laterally opposed side of said drawing board, a base arm having a linear upper surface, and first and second connecting arms, one of said connecting arms connected at an upper end to an outer end of said pivot arm and a lower end connected at an out end of said base arm, the other of said connecting arms connected at an upper end to an inner end of said pivot arm and a lower end connected at a middle portion of said base arm, the arrangement being such that said arms can be relative adjusted to position said linear upper surface of said base arm at a horizontal base line on the drawing surface at a base line position, and means for fixing said pivot arm to said drawing board at said base line position, whereby movement of said base arm from said base line position may be used to create perspective lines referenced by said linear surface and substantially intersecting at a vanishing point remote from the drawing surface.

2. The drafting device as recited in claim 1 wherein said pivot arm may be rotated to establish varying vertical positions for said base line.

3. The drafting device as recited in claim 2 wherein said pivot arm is centrally pivotally connected to said drawing board.

4. The drawing device as recited in claim 1 wherein said means for pivotal connection includes a plurality of side apertures through said laterally opposed sides of said board and a pivot aperture in said pivot arm, and fastener means extending one of said side apertures and said pivot aperture for thereby establishing said pivotal connection.

5. The drafting device as recited in claim 4 wherein said means for pivotal connection includes pivot apertures at a top edge of said drawing board for receiving said fastener means for connection with said pivot arm.

* * * * *